United States Patent [19]

Feder

[11] Patent Number: 4,815,893

[45] Date of Patent: Mar. 28, 1989

[54] SELF-CONTAINED UNDERWATER DRINKING APPARATUS FOR SCUBA DIVERS

[76] Inventor: Irving Feder, 2145 NE. Miami Gardens Dr., North Miami Beach, Fla. 33179

[21] Appl. No.: 74,677

[22] Filed: Jul. 17, 1987

[51] Int. Cl.[4] ..... B63C 11/02

[52] U.S. Cl. ..... 405/186; 128/202.15

[58] Field of Search ..... 405/186; 128/202.15; 441/86, 102, 106, 108

[56] References Cited

U.S. PATENT DOCUMENTS

| | | | |
|---|---|---|---|
| 183,521 | 10/1876 | Weck | 128/202.15 X |
| 1,366,437 | 1/1921 | Wagenhorst | 128/202.15 |
| 3,964,266 | 6/1976 | Bartlett | 405/186 |
| 4,045,835 | 9/1977 | Flam et al. | 405/186 |
| 4,090,650 | 5/1978 | Gotta | 224/148 |
| 4,139,130 | 2/1979 | Glusker et al. | 224/148 |
| 4,176,772 | 12/1979 | Danon | 224/148 |
| 4,398,533 | 8/1983 | Barker | 128/202.15 |
| 4,526,298 | 7/1985 | Boxer et al. | 222/130 |
| 4,627,554 | 12/1986 | Leibinsohn | 222/103 |
| 4,629,098 | 12/1986 | Eger | 222/175 |

FOREIGN PATENT DOCUMENTS

| | | | |
|---|---|---|---|
| 2045094 | 10/1980 | United Kingdom | 128/202.15 |

*Primary Examiner*—Dennis L. Taylor

*Attorney, Agent, or Firm*—Herbert L. Lerner; Laurence A. Greenberg

[57] ABSTRACT

A self-contained underwater drinking apparatus for scuba divers includes a container for liquid, a tube connected to said container for receiving the liquid from said container, and a mouthpiece integral with said tube for receiving the liquid from said tube. The mouthpiece can be attached to a regulator supplying air to the diver.

16 Claims, 3 Drawing Sheets

SELF-CONTAINED UNDERWATER DRINKING APPARATUS FOR SCUBA DIVERS

The invention relates to a drinking apparatus to be used by scuba divers when above and under water. Such a device is unknown in the prior art.

Scuba divers carry with them enough air in tanks to enable them to remain under water for extended periods of time. However, a diver's mouth or throat will often become dry because the air in the tanks lacks humidity, or salt water which has entered the diver's mouth may irritate the throat, cause nausea and/or indigestion. Furthermore, a diver may be surrounded by dangerous and perhaps toxic chemicals in the water which require the diver to ingest a medicinal liquid or to use a mouthwash if such substances are swallowed. When this occurs, the diver may have to return to the surface merely for the purpose of ingesting liquid.

U.S. Pat. Nos. 4,090,650; 4,139,130; and 4,176,772 relate to canteens or containers which are worn around the waste and have outlets for dispensing liquid for drinking. Similarly, U.S. Pat. No. 4,629,098 provides an insulated container which has a dispensing tube and a bulb connected to the tube for pressurizing the liquid in the container. Such devices are used while hiking or while engaged in other sports above water.

U.S. Pat. No. 4,627,554 discloses a collapsible container for dispensing infusion liquids at a constant pressure for medical purposes. The device uses an outlet tube to feed the liquid to a patient who will also be above water. Finally, U.S. Pat. No. 4,526,298 discloses a container to be used by a hiker and therefore above water, which includes a trigger-operated nozzle attached to the container through a tube for spraying liquid.

All of the above-described devices used for drinking provide tubes or other outlet means which are placed in the mouth for drinking and are removed from the mouth for breathing. Naturally, this presents no problem when above water, but it would make the devices difficult or impossible to use underwater.

It is accordingly an object of the invention to provide a drinking apparatus for scuba divers, which overcomes the hereinafore-mentioned disadvantages of the heretofore-known devices of this general type and which can be used without disturbing or interfering with the underwater breathing apparatus used by the diver.

With the foregoing and other objects in view there is provided, in accordance with the invention, a drinking apparatus for scuba divers, comprising a container for liquid, a tube connected to the container for receiving the liquid from the container, and a mouthpiece integral with the tube for receiving the liquid from the tube, the mouthpiece having means for attaching the mouthpiece to a regulator supplying air to the diver.

Through the use of the invention, the diver will be able to drink a liquid when desired, without removing the mouthpiece and the regulator attached thereto for supplying air.

In accordance with another feature of the invention, the container is flexible, and there are provided means connected to the tube for permitting the liquid to flow through the tube when the container is squeezed and preventing the liquid from flowing through the tube when the container is not squeezed. In accordance with a further feature of the invention, the means for permitting and preventing liquid flow is a check valve. In this way there is very little chance that liquid will flow to the mouthpiece when not desired and liquid will be prevented from returning to the container.

In accordance with an added feature of the invention, there is provided a a quick disconnect check valve connected to the tube between the first-mentioned check valve and the mouthpiece. This feature permits the container to be easily disconnected from the mouthpiece, while preventing water from entering the mouthpiece from the surroundings.

In accordance with an additional feature of the invention, there is provided an on-off valve connected to the tube between the check valves. The on-off valve provides a positive means for shutting off flow from the container even when it is squeezed.

In accordance with yet another feature of the invention, there is provided a flange connecting the container to the tube, the first-mentioned check valve being disposed in the flange and the on-off valve being connected to the flange. This construction makes use of readily available parts for assembling the device.

In accordance with yet a further feature of the invention, the container includes means for fixing the container in place. In accordance with yet an added feature of the invention, the container includes means for connecting the container to an air hose connected to the regulator. In accordance with yet an additional feature of the invention, the container has flaps and the fixing means are in the form of hook and loop fasteners disposed on the flaps. Such a structure makes the device easy to attached to and remove from an accessible location on the diver's equipment.

In accordance with still another feature of the invention, the container includes an outer pouch having means for fixing the container in place, an inner pouch being disposed in the outer pouch and having a filling opening formed therein for the liquid, and means for retaining the inner pouch in the outer pouch. In accordance with still a further feature of the invention, the outer pouch has a flap and the retaining means are in the form of hook and loop fasteners disposed on the flap. This construction of the container makes it easy to fill and attach.

In accordance with a concomitant feature of the invention, the mouthpiece includes a bitepiece, a portion of the tube being integral with the bitepiece. The placement of the tube in this way ensures that it will not annoy the diver.

Other features which are considered as characteristic for the invention are set forth in the appended claims.

Although the invention is illustrated and described herein as embodied in a self-contained underwater drinking apparatus for scuba divers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a diagrammatic, perspective view of the drinking apparatus for scuba divers according to the invention, being worn by a diver:

FIG. 2 a fragmentary, side-elevational, exploded view of the different parts of the apparatus except for the container:

Figure 1:
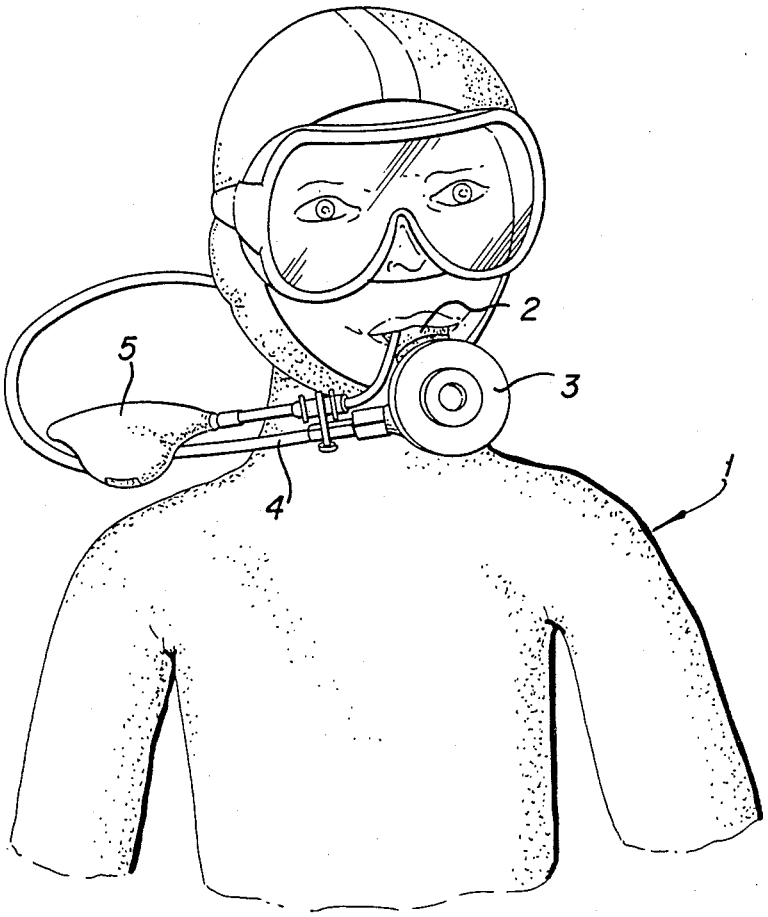

Referring now to the figures of the drawings in detail and first, particularly, to FIG. 1 thereof, there is seen a diver 1 with a mouthpiece 2 in the diver's mouth. A conventional regulator 3 is attached to the mouthpiece 2 and an air hose leads from the regulator to non-illustrated tanks worn on the diver's back. The drinking apparatus includes a container 5 connected to the mouthpiece 2 through valves and hoses to be described below. The container may also be attached to the air hose 4 as shown and described below.

Figure 2:
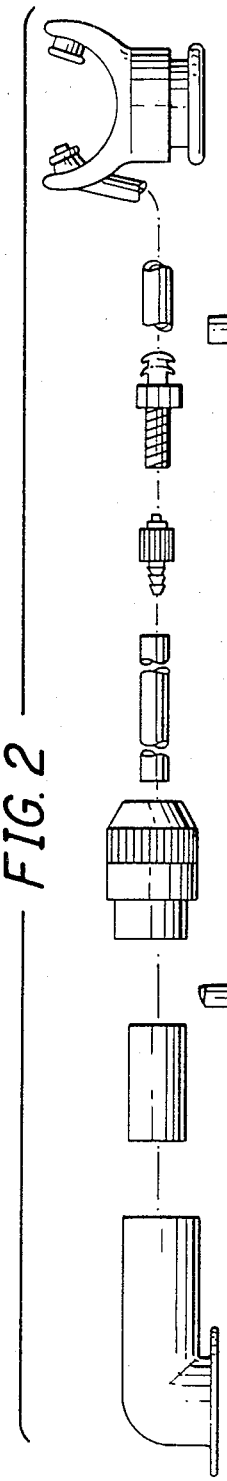

FIG. 2 shows a right angle flange 6 which may be model No. 727 AC sold by the firm Halkey-Roberts of St. Petersburg, Fla., which has an end 6*a* that is connected to the container 5 in a manner that will be described in more detail below. A check valve 7 which may be model No. C 730 of Halkey-Roberts is placed completely inside an end 6*b* of the flange 6 in a direction preventing flow into the container 5. The valve 7 fits snugly into the flange so as to prevent leakage around the valve. The valve has a given cracking pressure in the unchecked direction adjusted by the manufacturer, which prevents liquid from pouring out of the container due to gravity. An on-off valve which may be model No. 320 TE of Halkey-Roberts is connected to the end 6*b* of the flange 6. The knurled portion of the valve 8 is pushed and pulled in order to close and open the valve. A tube 9 which is a conventional plastic tube or a rubbery tube which may be made of rubber or its generic equivalent is attached to the valve 8. A quick disconnect fitting 10 which is connected to the tube 9 may be model No. 55-02-02 of the firm ADI. The fitting 10 has a barb connector 11 which is forced into the tube 9. A knurled nut 12 which is unchecked male side of the fitting 10, is attached to the connector 11. A valve body 13 which is the checked female side of the fitting 10 is screwed to the nut 12 and carries another knurled portion 14 and another barbed connector 15. Another tube 16 is forced on the connector 15. The tube 16 is integral with or adhesively or mechanically connected to the mouthpiece 2. The tube 16 has an outlet portion 17 which may or may not protrude from a bitepiece 18 of the mouthpiece. The tubes 9 and 16 may be of any length desired so that the distance between the mouthpiece and the container can be selected accordingly.

Figure 5:
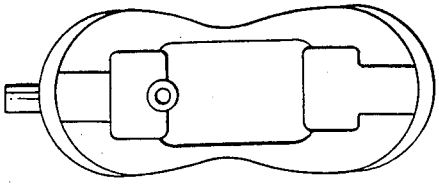
FIG. 5 is a fragmentary, right-side elevational view of the mouthpiece of the invention.
Figure 4:
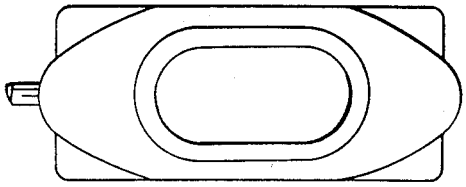
FIG. 4 is a fragmentary, left-side elevational view of the mouthpiece of the invention.

FIG. 4 shows the end of the mouthpiece 2 at which the regulator 3 is attached. The regulator has a non-illustrated portion which protrudes into a hole 19 in the mouthpiece. FIG. 5 shows the side of the mouthpiece which is inserted into the mouth of the diver. Both figures show the tube 16 and FIG. 5 clearly illustrates the bitepiece 18 and the outlet portion 17. The outlet portion 17 may face in other directions relative to the bitepiece 18, as desired for the comfort and convenience of the diver.

Figure 3C:
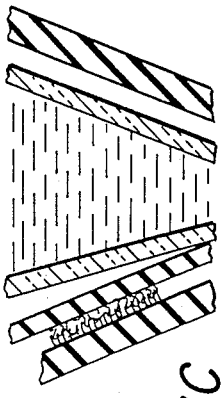
FIGS. 3A, 3B and 3C are cross-sectional views of portions of the container taken along the lines IIIA—IIIA, IIIB—IIIB and IIIC—IIIC in FIG. 3, respectively, in the direction of the arrows.
Figure 3B:
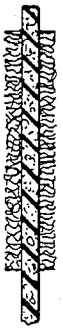
Figure 3A:
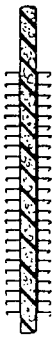
Figure 3:
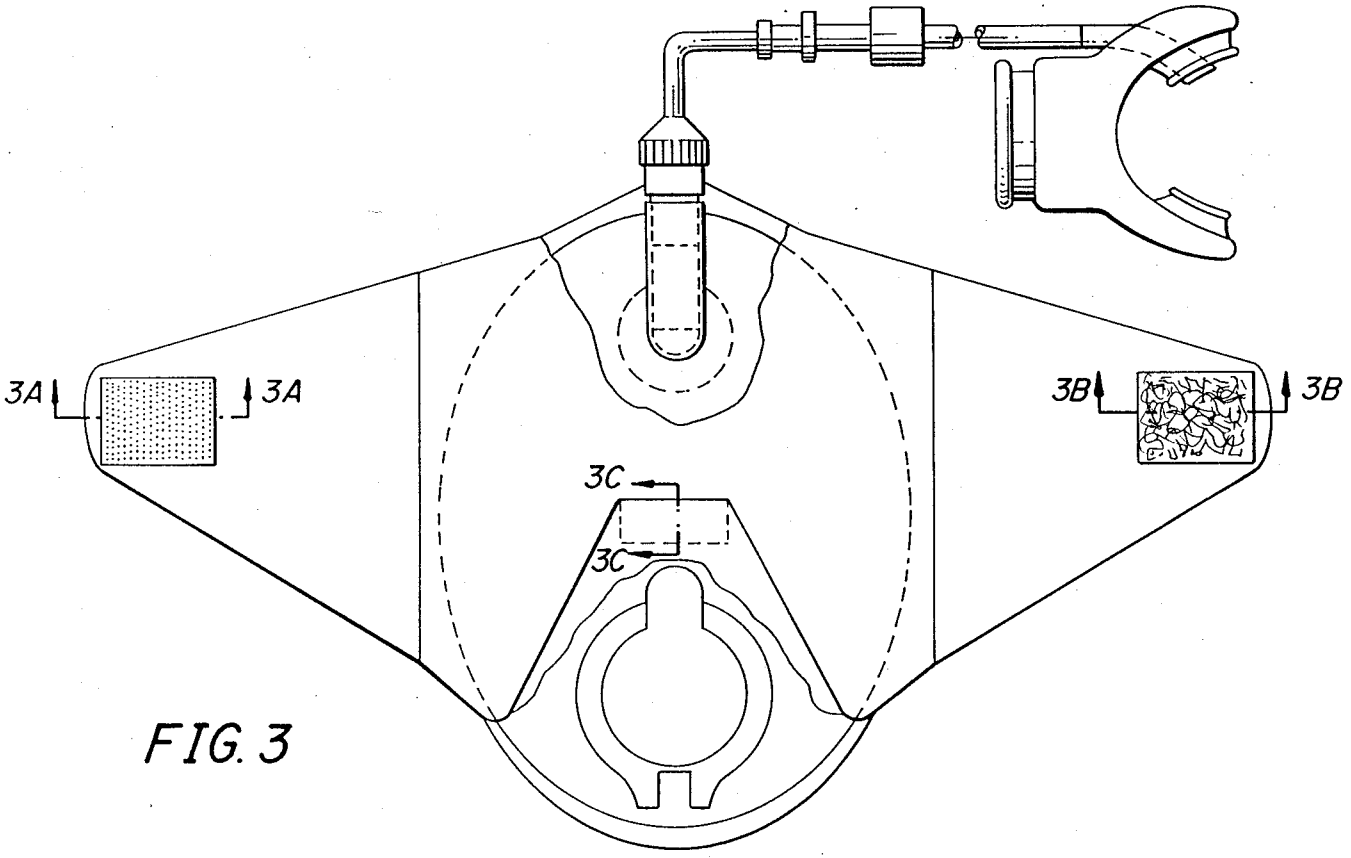
FIG. 3 is a partly broken away, top-plan view of the entire apparatus with a portion of a tube removed.

The container 5 is shown in greater detail in FIG. 3. The container includes an outer pouch 20 having a body and three flaps 21, 22 and 27. As shown in FIGS. 3, 3A and 3B, the flap 21 has hook fasteners 23 and 24 disposed on both sides thereof and the flap 22 has loop fasteners 25 and 26 formed on both sides thereof. In this way the container 5 can be wrapped around the air hose 4 as shown in FIG. 1 with either the flap 21 over the flap 22 or vice versa. Since either the hook fasteners 24 or the loop fasteners 26 will always remain exposed, the container can also be attached to fasteners placed on or formed as part of or inside the diver's wet suit, such as under the arm, or on another part of the diver's equipment, such as on or in a buoyancy compensator. The container may also be placed in a pocket in the buoyancy compensator or in the wet suit.

Referring to FIGS. 3 and 3C, it is seen that the third flap 27 has been broken away in FIG. 3 to show an inner pouch 28 which contains liquid 29 shown in FIG. 3C. The inner pouch 28 is filled while in the outer pouch 20 by opening the flap 27 and a flow check valve 31 having a hinged lid 32, which may be Halkey-Roberts model No. 1020 AF. The flow check valve 31 is attached to the inner pouch in a manner similar to the attachment of the flange 6. The flap 27 is held in the closed position by hook and loop fasteners 30 on the flap 27 and on the body of the outer pouch 20.

The upper portion of the outer pouch 20 has also been broken away to show that the end 6*a* of the flange 6 is disposed in the inner pouch 28. The flange passes through an opening 34 formed in the outer pouch. The inner pouch may be formed of insulating material and the end 6*a* may be secured as shown in U.S. Pat. No. 4,526,298.

In order to use the drinking apparatus of the invention, the container 5 is attached to a diver's air hose with the hook and loop fasteners on the flaps as described above. The mouthpiece 2 which is attached to the container 5 through elements 6–16 is placed in the diver's mouth, as shown in FIG. 1. The on-off valve 8 is normally pulled to place it in the to open condition as soon as the diver has reached his destination. When liquid is to be supplied to the diver's mouth, the diver merely squeezes the outer container 5 with his hand and a portion of the liquid will flow through the outlet portion 17. The check valve of the quick disconnect fitting 10 does not check fluid flow when connected. However, the check valve 7 will prevent the liquid from flowing back into the container and it will also prevent liquid from flowing to the outlet means 17 when the container is not squeezed. If the container is placed under the diver's arm, the action of the arm or elbow against the body will squeeze the container.

If the fitting 10 is disconnected while under water, or if the diver wishes to dive without the container and has removed the container with the elements 6–9, the check valve in the quick disconnect fitting will prevent water from the surroundings from flowing into the tube 16. Similarly, if the fitting is disconnected or the container filled with liquid remains above water, the check valve 7 and the on-off valve 8 will prevent the liquid from pouring out of the container.

I claim:

1. Self-contained underwater drinking apparatus for scuba divers, comprising a container for liquid, a tube connected to said container for receiving the liquid from said container, a mouthpiece integral with said tube to be placed in the mouth of the diver for receiving the liquid from said tube, and means for forcing liquid from said container through said tube and into said mouthpiece, said mouthpiece having means for attaching said mouthpiece to a regulator supplying air to the diver, whereby a diver may receive both liquid and air through said mouthpiece without removing said mouthpiece from the mouth of the diver.

2. Drinking apparatus according to claim 1, wherein said container is flexible, and including means connected to said tube for permitting the liquid to flow through said tube when said container is squeezed and preventing the liquid from flowing through said container when said tube is not squeezed.

3. Drinking apparatus according to claim 2, wherein said means for permitting and preventing liquid flow is a check valve.

4. Drinking apparatus according to claim 3, including a quick disconnect check valve connected to said tube between said first-mentioned check valve and said mouthpiece.

5. Drinking apparatus according to claim 4, including an on-off valve connected to said tube between said check valves.

6. Drinking apparatus according to claim 5, including a flange connecting said container to said tube, said first-mentioned check valve being disposed in said flange and said on-off valve being connected to said flange.

7. Drinking apparatus according to claim 1, wherein said container includes means for fixing said container in place.

8. Drinking apparatus according to claim 1, wherein said container includes means for connecting said container to an air hose connected to the regulator.

9. Drinking apparatus according to claim 7, wherein said container has flaps and said fixing means are in the form of hook and loop fasteners disposed on said flaps.

10. Drinking apparatus according to claim 1, wherein said container includes an outer pouch having means for fixing said container in place, an inner pouch being disposed in said outer pouch and having a filling opening formed therein for the liquid, and means for retaining said inner pouch in said outer pouch.

11. Drinking apparatus according to claim 10, wherein said outer pouch has a flap and said retaining means are in the form of hook and loop fasteners disposed on said flap.

12. Drinking apparatus according to claim 10, including a flange connected to said inner pouch, a first check valve disposed in said flange, an on-off valve connected to said flange, and a quick disconnect check valve connected between said on-off valve and said mouthpiece.

13. Drinking apparatus according to claim 1, wherein said mouthpiece includes a bitepiece, and said tube has a portion being integral with said bitepiece.

14. Method for supplying liquid to the mouth of a scuba diver under water, which comprises connecting a mouthpiece to a regulator supplying air to the mouthpiece, connecting a tube to the mouthpiece, connecting a container for liquid to the tube, and squeezing the container forcing liquid from the container through the tube into the mouthpiece, whereby a diver may receive both liquid and air through the mouthpiece without removing the mouthpiece from the mouth of the diver.

15. Method according to claim 14, which comprises preventing the liquid from flowing through the tube when the container is not squeezed.

16. Drinking apparatus according to claim 1, wherein said attaching means of said mouthpiece are separate from said tube.

* * * * *

UNITED STATES PATENT OFFICE

CERTIFICATE OF CORRECTION

PATENT NO. 4,815,893

DATED March 28, 1989

INVENTOR(S) Irving Feder

It is certified that error appears in the above-identified patent and that said Letters Patent is hereby corrected as shown below:

In the Claims:

Claim 2, lines 5 and 6, change "said container when said tube is not squeezed"

to - - said tube when said container is not squeezed. - - .

Signed and Sealed this

Thirty-first Day of July, 1990

*Attest:*

*Attesting Officer*

HARRY F. MANBECK, JR.

*Commissioner of Patents and Trademarks*